United States Patent [19]

Fujikawa et al.

[11] Patent Number: 4,590,891

[45] Date of Patent: May 27, 1986

[54] ENGINE COOLING SYSTEM IN FIELD MACHINERY

[75] Inventors: Tetsuzo Fujikawa, Kobe; Tamba Shinichi, Kakogawa, both of Japan

[73] Assignee: Kawasaki Jukogyo Kabushiki Kaisha, Hyogo, Japan

[21] Appl. No.: 673,438

[22] Filed: Nov. 20, 1984

[30] Foreign Application Priority Data

Nov. 22, 1983 [JP] Japan ..... 58-180657[U]

[51] Int. Cl.[4] ..... F01P 3/18

[52] U.S. Cl. ..... 123/41.11; 123/41.49; 180/68.4

[58] Field of Search ..... 123/41.01, 41.11, 41.12, 123/41.48, 41.49; 180/68.4, 68.6, 68 R

[56] References Cited

U.S. PATENT DOCUMENTS

| | | | |
|---|---|---|---|
| 2,913,065 | 11/1959 | Lyon, Jr. | 180/68.6 |
| 3,727,712 | 4/1973 | Colloton | 180/68.4 |
| 4,117,902 | 10/1978 | Henline et al. | 180/68.4 |
| 4,445,587 | 5/1984 | Hillman | 123/41.01 |
| 4,492,282 | 1/1985 | Appelblatt et al. | 180/68.4 |
| 4,501,129 | 2/1985 | Charles | 180/68.4 |

FOREIGN PATENT DOCUMENTS

| | | | |
|---|---|---|---|
| 3110447 | 11/1982 | Fed. Rep. of Germany | 180/68.4 |

*Primary Examiner*—William A. Cuchlinski, Jr.

[57] ABSTRACT

An engine cooling system for field machinery such as tractors equipped with a lawnmower. A cooling system is arranged with a radiator placed in a slanting position in the upper rear part of engine within engine room and with the lower end of the radiator placed on the engine side. A cooling fan is so mounted that the cooling air induced by the radiator cooling fan passes through upward from under the radiator. The cooling fan is preferably placed downstream in the cooling air flow of the radiator, that means, above the radiator. Further it is desirable that a cooling air passage is so arranged that the cooling air which has passed through the radiator may blow out of air outlet through the vicinity of the engine, and that the outgoing air flow is so directed that hay blown up by field machinery's travels and operations be kept away from cooling air inlet, for instance, being directed forward ahead of the engine.

1 Claim, 3 Drawing Figures

ENGINE COOLING SYSTEM IN FIELD MACHINERY

FIELD OF THE INVENTION

This invention relates to an engine cooling system for field machinery, such as tractors equipped with a lawnmower.

DESCRIPTION OF THE PRIOR ART

Conventional field machinery, such as combine harvesters and lawnmowers has a drawback that their movement flies up hay and especially hay flown up mostly in front of the field machinery sticks a surface on the air intake side of radiator for engine cooling.

For this reason, a screen is provided on the surface on the air intake side of radiator, but small particles such as small hay or dandelion seeds block said screen or pass through the screen, blocking the radiator itself, thus causing engine overheat.

Figure 1:
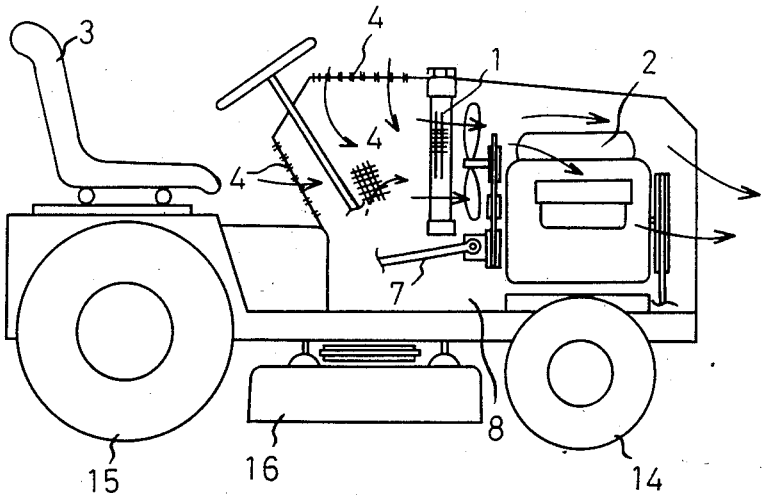
FIG. 1 PRIOR ART
FIG. 1 is a sectional side view showing a conventional example.
Figure 2:
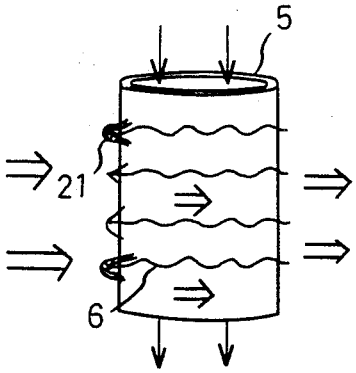
FIG. 2 PRIOR ART
FIG. 2 is an enlarged perspective view showing radiator piping in a radiator equipped in the machinery shown in FIG. 1.

To solve aforesaid drawbacks of the prior art gave rise to the existing proposals of providing said screen with a cleaning device or locating a radiator 1 on the side of driver's seat 3 in the back of engine 2 as shown in FIG. 1. The former is advantageous to cleaning of screen, and the latter is advantageous in that hay flown up in front of field machinery can hardly reach a radiator 1 and that clogging of hay on screen 4 can be well seen from the driver's seat 3. And both are to catch hay and other obstacles at a screen 4 on the upstream side of cooling air flow for radiator 1. Such means are effective by finer mesh screens 4, but extremely light and small particles such as dandelion seeds pass through screen 4 and also mostly even through radiator 1. Nevertheless, as shown in FIG. 2, part of grass and seeds have been a first cause of radiator clogging, because they are caught by fins 6 of pipes 5 in radiators 1, staying on the front face of the radiator 1.

Furthermore, when a radiator 1 is placed on the side of the driver's seat 3 as shown in FIG. 1, the position of the radiator 1 becomes high because it must clear the output shaft 7 of an engine 2 which is arranged in the lower part of the engine room 8, which results in high-back engine room 8, thus causing the drawback of extremely poor front visibility of the driver from the driver's seat 3.

SUMMARY OF THE INVENTION

To solve aforesaid drawbacks of the prior art gave rise to the present invention.

Thus it can be said that the purpose and object of this invention is to provide field machinery with an engine cooling means which can effectively prevent radiators from clogging and secure good front visibility owing to lower suppressed height of the engine room as well as facilitate engine output to be transmitted from the crankshaft direct to the rear portion through drive shaft.

To achieve aforesaid purpose, a cooling system according to the invention is characterized by arranging a radiator in a slanting position in the upper rear part of engine within engine room with the lower end of the radiator placed on the engine side, as well as by mounting a cooling fan so that the cooling air induced by the radiator cooling fan passes through upward from under the radiator. The cooling fan is preferably placed downstream in the cooling air flow of the radiator, that means, above the radiator e.g. Further it is desirable that a cooling air passage is so arranged that the cooling air which has passed through the radiator may blow out of air outlet through the vicinity of the engine, and that the outlet air flow is so directed that hay blown up by field machinery's travels and operations be kept away from cooling air inlet. For instance, the cooling air outlet is so placed near the front end of the field machinery that outlet air is directed forward away from the engine.

According to this configuration, since a relatively wide space is provided up the radiator, the cooling air velocity is so retarded in this space that relatively heavier hay and seeds can be separated from the main flow, and because of the downward air-receiving surface of the radiator, hay that has attached to the surface may drop off by their own weight when the cooling fan comes to a halt, as well as since the cooling air which blows out in front of the field machinery through the cooling air passage flies up hay ahead, much lesser hay will reach the radiator, thus resulting in effectively preventing the radiator from clogging. Said slanting radiator provides for a lower position of the top end of the radiator, consequently a lower engine room height, so that the engine room becomes smaller, making the operator's front visibility much better. Further a higher position of the bottom of the radiator facilitates direct transmission of output from the crankshaft to the rear portion in terms of space.

DETAILED DESCRIPTION OF THE PREFERRED EMBODIMENT

Figure 3:
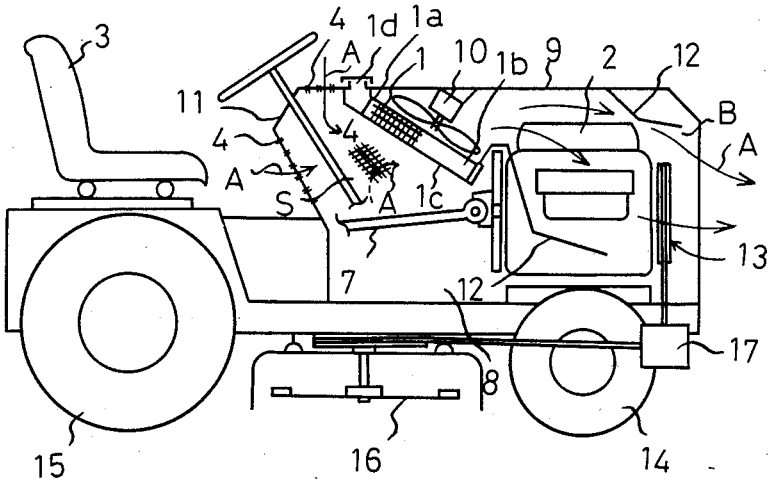
FIG. 3 is a sectional side view showing an embodiment according to this invention.

Referring now in detail to the illustrative embodiment depicted in FIG. 3, there is shown an engine cooling system according to the present invention, compared together with FIG. 1 or the illustrative drawing of the prior art wherein like reference characters denote like parts.

Numeral 1 is a radiator for removing heat from cooling water in a water-cooled engine for recirculation, numeral 4 being a screen mesh, 7 being an output shaft for rear wheel drive, 8 being an engine room, and said radiator 1 is arranged in the upper rear of the engine 2 in the engine room 8.

Numeral 9 is a room cover for engine room 8, to the room cover 9 being connected said radiator 1, screen 4, cooling fan 10, front panel 11 and water supply port 1*d*.

Said radiator 1 is placed with the top end on the side of front panel 11, with the bottom end on the side of engine 2, and with the air receiving surface 1*c* downwardly slanting, above the air exit surface of the radiator 1 being mounted a cooling fan 10 underneath the room cover 9.

Numeral 12 is a duct arranged around said engine 2, the duct 12 and room cover 9 combine to form a cooling air passage B through which the cooling air A blows out in front of the field machinery from around the engine 2. Numeral 13 is a transmission mechanism which carries the drive force of the engine 2 to a lawnmower mounted between front and rear wheels 14 and 15, partly including a transmission direction-changing mechanism 17 comprising a combination of gears.

In said configuration, driving the cooling fan 10 provides the following cooling air flow: Cooling air A is drawn from the screen 4 close to the front panel 11 into the room cover 9: the air passes through the radiator 1 from the downwardly slanting surface 1*c* of the radiator 1: and thereafter it enters the cooling air passage B to perform ventilation near the engine 2, finally blows out in front of the field machinery through the cooling air passage B.

Placement of said radiator 1 in the rear of the engine 2 within the engine room allows the screen 4 which filters cooling air A to be removed away from work machinery front where a great amount of hay is likely to fly up, thus resulting in as less hay involved in cooling air A that flows into from the screen 4. Said slanting radiator 1 provides for a relatively wide space between radiator 1 and screen 4 so that the speed of the cooling air A flowing into said space S from the screen 4 is retarded in this space enough for relatively heavy ones among flying hay included in the cooling air A to separate from main flow and drop off on the bottom of the engine room 8. Therefore, before the cooling air reaches the radiator 1, hay content of the cooling air A becomes substantially less. Furthermore, since the radiator 1 is slanted with the bottom end 1*b* of the raidator 1 placed on the engine side, the receiving-side surface 1*c* of the radiator 1 directs downwards, thus permitting the hay stuck to the surface 1*c* to drop off due to their own weight when the engine, that is the cooling fan comes to a halt, which effectively prevents the radiator 1 from being clogged.

Since the cooling air A that has performed ventilation of aforesaid engine 2 flows out ahead of the field machinery through the cooling air passage B to blow off much farther the hay flying up in front of the machinery, a maximum of hay reaching the vicinity of the screen 4 for introducing cooling air can be eliminated, thus all the more effectively preventing the radiator 1 from becoming clogged.

Said slanting radiator 1 permits a lower position of the top 1*a* of the radiator 1, thus preventing an engine room 8 from becoming high. The lower the top of the radiator, the more compact becomes the engine room 8, and the better becomes the front visibility of the driver. Furthermore the higher position of the bottom 1*b* of the radiator helps arrange output shaft 7 directly to the rear portion from crankshaft in terms of space.

Although field machinery which are equipped with a horizontal shaft-type engine are illustrated in FIG. 3, this invention can apply to field machinery equipped with a vertical shaft-type engine. And the invention can also apply successfully to field machinery with an engine located at the rear part of machinery.

What is claimed is:

1. A cooling system for an engine in a compartment forming part of a farm machine exposed to small plant particles, comprising a cooling radiator in an upper portion of said compartment and rearwardly of said engine, said radiator being disposed angularly from the horizontal with the lower end thereof slanting toward said engine;

a cooling fan disposed above said radiator to draw cool air from beneath and upwardly through said radiator;

a cooling air inlet disposed in the upper rear portion of said compartment; and an exhaust air outlet disposed near the front end of said compartment to direct the exhaust air ahead of said machine, whereby to blow such plant particles ahead of the machine and minimize the amount thereof reaching said cooling air inlet.

* * * * *